US008118996B2

(12) United States Patent
Stell et al.

(10) Patent No.: US 8,118,996 B2
(45) Date of Patent: Feb. 21, 2012

(54) APPARATUS AND PROCESS FOR CRACKING HYDROCARBONACEOUS FEED UTILIZING A PRE-QUENCHING OIL CONTAINING CRACKABLE COMPONENTS

(75) Inventors: Richard C. Stell, Houston, TX (US); Megan Renstrom Bleckinger, Seabrook, TX (US); James N. McCoy, Houston, TX (US); Arthur R. Di Nicolantonio, Seabrook, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 1045 days.

(21) Appl. No.: 12/029,555

(22) Filed: Feb. 12, 2008

(65) Prior Publication Data

US 2008/0221378 A1 Sep. 11, 2008

Related U.S. Application Data

(60) Provisional application No. 60/905,967, filed on Mar. 9, 2007.

(51) Int. Cl.
*C10G 55/04* (2006.01)

(52) U.S. Cl. ..... 208/130; 208/71; 208/95; 585/903

(58) Field of Classification Search ..... None
See application file for complete search history.

(56) References Cited

U.S. PATENT DOCUMENTS

| | | | | |
|---|---|---|---|---|
| 3,103,485 | A * | 9/1963 | Cahn | 208/130 |
| 3,593,968 | A | 7/1971 | Geddes | |
| 3,617,493 | A | 11/1971 | Wirth | |
| 3,718,709 | A | 2/1973 | Simonetta | |
| 3,907,661 | A | 9/1975 | Gwyn et al. | |
| 3,923,921 | A | 12/1975 | Kohfeldt | |
| 3,959,420 | A | 5/1976 | Geddes et al. | |
| 4,121,908 | A | 10/1978 | Raab et al. | |
| 4,233,137 | A | 11/1980 | Ozaki et al. | |
| 4,384,160 | A | 5/1983 | Skraba | |
| 4,444,697 | A | 4/1984 | Gater et al. | |
| 4,663,019 | A | 5/1987 | Gartside et al. | |
| 5,139,650 | A | 8/1992 | Lenglet | |
| 5,580,443 | A | 12/1996 | Yoshida et al. | |
| 6,626,424 | B2 | 9/2003 | Ngan et al. | |
| 7,097,758 | B2 | 8/2006 | Stell et al. | |
| 7,138,047 | B2 | 11/2006 | Stell et al. | |
| 2004/0004022 | A1 | 1/2004 | Stell et al. | |
| 2005/0209495 | A1 | 9/2005 | McCoy et al. | |
| 2005/0261531 | A1 * | 11/2005 | Stell et al. | 585/648 |
| 2005/0261537 | A1 | 11/2005 | Stell et al. | |
| 2006/0249428 | A1 | 11/2006 | Stell et al. | |
| 2007/0007172 | A1 | 1/2007 | Strack et al. | |
| 2007/0007173 | A1 | 1/2007 | Strack et al. | |

FOREIGN PATENT DOCUMENTS

| | | |
|---|---|---|
| EP | 911 378 | 4/1999 |
| GB | 1 024 667 | 3/1966 |
| WO | WO 93/12200 | 6/1993 |

OTHER PUBLICATIONS

U.S. Appl. No. 11/634,301, filed Dec. 5, 2006, McCoy et al.

* cited by examiner

*Primary Examiner* — Tam M Nguyen

(57) ABSTRACT

An apparatus and process are provided for cracking hydrocarbons. Hot, cracked effluent is removed to a quench header where it is pre-quenched with an oil containing crackable components, e.g., 1000° F.$^+$ (538° C.$^+$) boiling range bottoms taken from a vapor/liquid separator, cracking the bottoms to more valuable products, e.g., steam crack naphtha. The overhead of the separator is fed to a cracker, and then quenched with a quenching oil.

10 Claims, 2 Drawing Sheets

APPARATUS AND PROCESS FOR CRACKING HYDROCARBONACEOUS FEED UTILIZING A PRE-QUENCHING OIL CONTAINING CRACKABLE COMPONENTS

PRIORITY CLAIM

This non-provisional application claims priority to and the benefit of U.S. Provisional Application Ser. No. 60/905,967, filed Mar. 9, 2007.

FIELD

The present invention relates to the cracking of hydrocarbons, especially those containing relatively non-volatile hydrocarbons and other contaminants. More particularly, the present invention relates to a quench header apparatus for pre-quenching hot cracker effluent using a crackable oil containing crackable components, e.g., 1000° F.$^+$ (538° C.$^+$) boiling range bottoms such as those taken from a vapor/liquid separator whose overhead is fed to a cracker. The invention further relates to an apparatus and process for cracking which employs the quench header.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace that has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products including olefins leave the pyrolysis furnace for further downstream processing, including quenching.

Pyrolysis involves heating the feedstock sufficiently to cause thermal decomposition of the larger molecules. The pyrolysis process, however, produces molecules that tend to combine to form high molecular weight materials known as tar. Tar is a high-boiling point, viscous, reactive material that can foul equipment under certain conditions. In general, feedstocks containing higher boiling materials tend to produce greater quantities of tar.

The formation of tar after the pyrolysis effluent leaves the steam cracking furnace can be minimized by rapidly reducing the temperature of the effluent exiting the pyrolysis unit to a level at which the tar-forming reactions are greatly slowed. This cooling, achieved in one or more steps and using one or more methods, is referred to as quenching. Quenching may be supplemented upstream of the quenching step by pre-quenching hot effluent with a pre-quenching oil. This reduces the process gas to a somewhat lower temperature, e.g., typically by less than about 100° F. (55° C.) cooler, at which temperature cracking can still occur.

Conventional steam cracking systems have been effective for cracking high-quality feedstock which contains a large fraction of light volatile hydrocarbons, such as gas oil and naphtha. However, steam cracking economics sometimes favor cracking lower cost heavy feedstocks such as, by way of non-limiting examples, crude oil and atmospheric residue. Crude oil and atmospheric residue often contain high molecular weight, non-volatile components with boiling points in excess of about 1100° F. (593° C.) otherwise known as resids. The non-volatile components of these feedstocks lay down as coke in the convection section of conventional pyrolysis furnaces. Only very low levels of non-volatile components can be tolerated in the convection section downstream of the point where the lighter components have fully vaporized.

In most commercial naphtha and gas oil crackers, cooling of the effluent from the cracking furnace is normally achieved using a system of transfer line heat exchangers, a primary fractionator, and a water quench tower or indirect condenser. The steam generated in transfer line exchangers can be used to drive large steam turbines which power the major compressors used elsewhere in the ethylene production unit. To obtain high energy-efficiency and power production in the steam turbines, it is necessary to superheat the steam produced in the transfer line exchangers.

Cracking heavier feeds, such as kerosenes and gas oils, produces large amounts of tar, which lead to fouling in the transfer line exchangers preferred in lighter liquid cracking service.

Additionally, during transport some naphthas are contaminated with heavy crude oil containing non-volatile components. Conventional pyrolysis furnaces do not have the flexibility to process residues, crudes, or many residue or crude contaminated gas oils or naphthas which are contaminated with non-volatile components.

To address coking problems, U.S. Pat. No. 3,617,493, which is incorporated herein by reference in its entirety, discloses the use of an external vaporization drum for the crude oil feed and discloses the use of a first flash to remove naphtha as vapor and a second flash to remove vapors with a boiling point between 450° F. and 1100° F. (232° C. and 593° C.). The vapors are cracked in the pyrolysis furnace into olefins and the separated liquids from the two flash tanks are removed, stripped with steam, and used as fuel.

U.S. Pat. No. 3,718,709, which is incorporated herein by reference in its entirety, discloses a process to minimize coke deposition. It describes preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are subjected to cracking. Periodic regeneration above pyrolysis temperature is effected with air and steam.

U.S. Pat. No. 5,580,443, which is incorporated herein by reference in its entirety, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

The bottoms obtained from a vapor/liquid separator or flash drum are typically suited for use only as relatively low value fuel oils, with no significant utility within the cracker itself. In view of the low value of such fuel oils versus intial feed values, it would be desirable to utilize the vapor/liquid separator bottoms in a higher value application, preferably within the overall cracking process itself.

Using heavy or residual materials, such as bottoms, as quench oils in steam cracking operations is known. U.S. Pat. No. 3,923,921 to Kohfeldt, incorporated herein by reference in its entirety, discloses quenching naphtha steam cracking effluent using a high boiling fraction, i.e., tar bottoms and a steam-cracked gas oil fraction, which fractions are recovered from the quench tower. U.S. Pat. No. 4,233,137 to Ozaki et al., incorporated herein by reference in its entirety, teaches treating hot cracked cracking effluent with a low temperature hydrocarbon oil of high thermal stability (e.g., an oil enriched with aromatics) which can be a by-product heavy oil from the thermal cracking or supplied from an outside source. U.S. Pat. No. 4,663,019 to Gartside et al., incorporated herein by reference in its entirety, teaches thermally cracking a side cut fraction from a fractionation tower fed with residual oil, and quenching the cracked product with residual oil. Coke produced from the quenched product provides reaction heat for the cracking.

EP 0 911 378 B1, incorporated herein by reference in its entirety, teaches reducing viscosity of circulating quench oil in a mixture of partially cooled cracker effluent by separating the resulting vapor and liquid, withdrawing vapor to a fractionator, and withdrawing liquid as a heavy, tarry, fuel oil product, which improves viscosity of the circulating oil.

Various injection nozzle designs for use in quenching cracked product streams are known. U.S. Pat. No. 3,593,968 to Geddes, incorporated herein by reference in its entirety, discloses cooling pyrolysis gases flowing downwardly through a quench zone whose walls are covered by a film of quench oil while spraying quench oil into the gas stream. The quench oil is directed through an annular opening comprising a frustoconical element. U.S. Pat. No. 3,959,420 to Geddes et al., incorporated herein by reference in its entirety, discloses a device wherein the entry of the quench chamber is in the form of an inverted frustum with a curved transition configuration between the inverted frustum and the straight wall of the quench chamber. Quench oil is added through a reservoir. U.S. Pat. No. 4,121,908 to Raab et al., incorporated herein by reference in its entirety, discloses an apparatus for cooling a cracking gas steam having a nozzle for introducing cooling oil mounted at the elbow of a cracking gas pipe (see FIG. 3).

U.S. Pat. No. 4,384,160 to Skraba, incorporated herein by reference in its entirety, discloses pre-quenching cracked effluents of ethane/propane feeds using hydrocarbons such as liquid ethane and/or propane.

It would be desirable to provide an apparatus and process for cracking feeds, including feeds that contain resids, which utilize bottoms obtained from a vapor/liquid separator used to treat resid-containing feeds prior to cracking. In particular, it would be advantageous to utilize such bottoms in higher value applications, rather than as fuels. Although the bottoms obtained from a vapor/liquid separator typically contain crackable components, they also contain asphaltenes, rendering these bottoms unfit for use as steam cracking feed. Moreover, the bottoms are not suited as quench oils because they contain paraffins, which, if uncracked, would cause precipitation of tar asphaltenes downstream in the transfer line and primary fractionator.

SUMMARY

It has now been found that bottoms containing crackable components, e.g., paraffins and naphthenes, taken from the vapor/liquid separator or flash drum, are particularly suited to use as a pre-quenching oil, which is introduced upstream of a quench oil inlet, under conditions which permit substantial cracking of the crackable components upstream of a quench oil inlet. By "substantially cracking" is meant at least about 50 wt %, say, at least about 80%, of the crackable components in the process gas mixture of hot effluent and pre-quenching oil are converted to cracked products as measured at or near the quenching oil inlet immediately downstream of the pre-quench cracking zone. For present purposes, flash (or partial) evaporation occurs where a vapor/liquid mixture is separated into a saturated vapor and a saturated liquid. The vapor/liquid mixture enters the flash zone through a large pipe so the pressure drop is nil. In the flash essentially no additional liquid flashes.

In one aspect, the present invention relates to a quench header apparatus suited to use as part of a process for cracking hydrocarbonaceous feed. The quench header apparatus, which can be a substantially tubular structure, comprises: a) an inlet for receiving hot cracked hydrocarbonaceous effluent; b) a pre-quenching oil inlet communicating with a source of pre-quenching oil containing crackable $C_5^+$ components; c) a cracking zone downstream of the pre-quenching oil inlet for substantially cracking the crackable components; d) a primary quenching oil inlet downstream of the cracking zone, and e) an outlet downstream of the quench oil inlet for removing quenched effluent for further processing.

In an embodiment of this aspect, the pre-quenching oil inlet communicates with a source of liquid bottoms from a vapor/liquid separator.

In another embodiment of this aspect of the invention, the pre-quenching oil inlet and the primary quenching oil inlet are separated to an extent sufficient to provide a process gas residence time therebetween of at least about 0.05 seconds for the cracked effluent and pre-quenching oil. Typically, the pre-quenching oil inlet and the primary quenching oil inlet are at least about 5 feet apart, e.g., at least about 12 feet apart.

In still another embodiment of this aspect, the pre-quenching oil inlet communicates with a source of quench oil and/or water for periodic flushing and/or spalling of coke and/or coke precursors which can accumulate during operation of the quench header.

In yet another embodiment of this aspect of the invention, the quench header apparatus further comprises a tar filter downstream of the pre-quenching oil inlet and also the point at which quenching oil is introduced. Tar filters are typically located in the primary fractionator circuit.

In still yet another embodiment of this aspect, the quench header apparatus comprises i) an upstream substantially horizontal section, ii) a downstream substantially vertical section, and a transition section iii) between i) and ii), comprising a substantially right angled bend, wherein the pre-quenching oil inlet is directed downstream through at least a portion of the transition section and substantially along the axis of the vertical section. These sections can range in diameter from about 3 to about 12 inches, (7.5 to 30 cm), preferably about 10 inches (25 cm).

In yet still another embodiment of this aspect of the invention, the outlet of the quench header communicates with a recovery train downstream.

In another embodiment of this aspect, the pre-quenching oil inlet, say, at the nozzle, has a diameter typically of at least about 0.5 (1.2 cm), e.g., about 0.5 to about 3 inches (1.2 to 7.5 cm), say, at least about 1 inch, (2.5 cm).

In still yet another embodiment of this aspect, the apparatus further comprises a secondary quenching oil inlet between the pre-quenching oil inlet and the primary quenching oil inlet and the secondary quenching oil inlet can communicate with a source of quench oil and/or water for periodic flushing and/or spalling of coke and/or coke precursors.

In another aspect, the present invention relates to a process for quenching hot cracked hydrocarbonaceous effluent that comprises: a) introducing hot cracked hydrocarbonaceous effluent to a quench header; b) introducing a pre-quenching oil containing crackable $C_5^+$ components to the quench header through a pre-quenching oil inlet for mixing with the hot cracked hydrocarbonaceous effluent, under conditions sufficient to substantially crack the crackable components in a cracking zone downstream of the pre-quenching oil inlet; and c) introducing a quenching oil to the quench header through a primary quenching oil inlet downstream of the cracking zone to substantially terminate further cracking in the effluent of the cracking zone and provide a quenched effluent.

In one embodiment of this aspect, the process further comprises: d) directing the quenched effluent to a recovery train.

In another embodiment of this aspect of the present invention, the process further comprises supplying a liquid bottoms phase derived from a vapor/liquid separator to the pre-quenching oil inlet.

In still another embodiment of this aspect, the pre-quenching oil is selected from the group consisting of vacuum pipestill bottoms, vapor/liquid separator bottoms from crude, vapor/liquid separator bottoms from hydrotreated crude, vapor/liquid separator bottoms from atmospheric resid, and vapor/liquid separator bottoms from hydrotreated atmospheric resid. Typically, the pre-quenching oil contains at least about 0.1 wt % asphaltenes, say, from about 2 to about 3 wt %.

In yet another embodiment of this aspect of the present invention, the pre-quenching oil inlet and the primary quenching oil inlet are separated to an extent sufficient to provide a process gas residence time ranging from about 0.04 to about 0.09 seconds for the cracked effluent and pre-quenching oil at a process gas flow rate between about 100 and about 300 feet/second (between about 30 and about 90 meters/second). Typically, the pre-quenching oil inlet and the primary quenching oil inlet are separated to an extent sufficient to provide a process gas residence time therebetween of about 0.06 seconds for the cracked effluent and pre-quenching oil at a process gas flow rate of about 200 feet/second (60 meters/second).

In still yet another embodiment of this aspect, the pre-quenching oil is added in an amount sufficient to lower the temperature of the hot cracked hydrocarbonaceous effluent by at least about 20° F. (11° C.), say, by at least about 35° F. (19° C.), e.g., by at least about 65° F. (36° C.). Typically, this temperature is lowered by no more than about 200° F. (111° C.), say, no more than about 100° F. (56° C.).

In yet still another embodiment of this aspect of the present invention, the pre-quenching oil is a 1000° F.$^+$ (538° C.$^+$) fraction containing at least about 60 wt % aromatics, at least about 0.1 wt % asphaltenes, less than about 5 wt % sulfur, and at least about 5 wt % paraffins, say, a 1000° F.$^+$ (538° C.$^+$) fraction containing from about 10 to about 80 wt % aromatics, from about 2 to about 10 wt % asphaltenes, from about 0.1 to about 5 wt % sulfur, and from about 0 to about 30 wt % paraffins.

In still yet another embodiment of this aspect, the pre-quenching oil is introduced to the hot cracked hydrocarbonaceous effluent at a rate sufficient to provide a mixture containing from about 1 to about 20 wt % pre-quenching oil in the cracking zone, say, a mixture containing from about 3 to about 10 wt % pre-quenching oil in the cracking zone.

In another embodiment of this aspect of the invention, the process further comprises periodically flushing the cracking zone of the quench header with quench oil and/or water introduced through the pre-quenching oil inlet for periodic flushing and/or spalling of coke and/or coke precursors. Typically, the flushing can be carried out for about 15 to about 30 minutes about every 6 to 24 hours.

In still yet another embodiment of this aspect, the process further comprises introducing quench oil and/or water through a secondary quenching oil inlet between the pre-quenching oil inlet and the primary quenching oil inlet for periodic flushing and/or spalling of coke and/or coke precursors In still another aspect, the present invention relates to an apparatus for cracking hydrocarbonaceous feed, which comprises: A) a convection zone containing one or more tube banks having heat exchange surfaces, which comprises 1) a hydrocarbonaceous feed inlet, 2) one or more inlets for introducing water and steam for mixing with the hydrocarbonaceous feed to provide a heated mixture stream containing hydrocarbonaceous feed, water and steam, and 3) a convection zone outlet for removing the heated mixture stream from the convection zone; B) a radiant zone beneath the convection zone which includes at least one burner producing flue gas passing upwards through the tube banks, which radiant zone receives the heated mixture stream from the convection zone outlet and further comprises a radiant zone outlet for removing hot cracked effluent; C) a quench header for receiving hot cracked effluent from the radiant zone outlet, the quench header comprising 1) a pre-quenching oil inlet for introducing into the hot cracked effluent a pre-quenching oil containing crackable $C_5^+$ components, 2) a cracking zone downstream of the pre-quenching oil inlet for substantially cracking the crackable components, 3) a quenching oil inlet downstream of the cracking zone, and 4) an outlet downstream of the quench oil inlet for removing a quenched effluent for further processing.

In one embodiment of this aspect of the invention, the pre-quenching oil inlet communicates with a source of liquid bottoms derived from a vapor/liquid separator. Typically, the vapor/liquid separator comprises an inlet to receive the heated mixture stream from the convection zone, an outlet for overhead vapor and an outlet for the liquid bottoms. The outlet for overhead vapor is advantageously connected to an inlet to a lower portion of the convection zone for further heating and processing.

In another embodiment of this aspect, the pre-quenching oil inlet communicates with a source selected from the group consisting of low sulfur vacuum pipestill bottoms, vapor/liquid separator bottoms from crude, vapor/liquid separator bottoms from hydrotreated crude, vapor/liquid separator bottoms from atmospheric resid, and vapor/liquid separator bottoms from hydrotreated atmospheric resid.

In still another embodiment of this aspect of the invention, the apparatus further comprises a recovery train downstream of the quench header.

In yet another aspect of the invention, the present invention relates to an apparatus for cracking hydrocarbonaceous feed, which comprises: I) a convection zone containing one or more tube banks having heat exchange surfaces, which comprises 1) a hydrocarbonaceous feed inlet, 2) one or more inlets for introducing water and steam for mixing with the hydrocarbonaceous feed to provide a heated mixture stream, 3) an upper outlet for directing the heated mixture stream to a vapor/liquid separator, 4) an inlet for receiving overhead vapor from the vapor/liquid separator for heating over the tube banks to provide a heated overhead vapor stream, and 5) a lower outlet for the heated overhead vapor stream; II) the vapor/liquid separator comprising an inlet for receiving the heated mixture stream from the convection zone, a bottoms outlet, and an overhead outlet; III) a radiant zone beneath the convection zone which includes at least one burner producing flue gas passing upwards through the tube banks, which radiant zone receives the heated stream from the lower outlet of the convection zone and further comprises an outlet for removing cracked effluent; IV) a quench header for receiving cracked effluent from the radiant zone the quench header having a pre-quenching inlet for a pre-quenching oil containing crackable components supplied from the bottoms outlet of the vapor/liquid separator, a cracking zone downstream of the pre-quench for substantially cracking the crackable components, a quenching oil inlet downstream of the cracking zone, and an outlet downstream of the quenching oil inlet for removing quenched effluent for further processing.

In yet another aspect, the present invention relates to a process for cracking hydrocarbonaceous feed that comprises: a) preheating the feed in one or more tube banks of a convection zone of a furnace, the feed being introduced to the tube bank(s) through at least one hydrocarbonaceous feed inlet; b) mixing the hydrocarbonaceous feed with water and steam added to the tube bank(s) via one or more inlets for introducing water and steam and removing the resulting heated mixture stream through an outlet in the tube bank(s); c) directing the heated mixture stream to a vapor/liquid separator; d) flashing the heated mixture stream in the vapor/liquid separator to provide a liquid bottoms phase and an overhead vapor phase; e) directing the overhead vapor phase to a tube bank of the convection zone in order to further heat the overhead vapor phase; f) cracking the further heated overhead vapor phase in a radiant zone beneath the convection zone, which includes burners producing flue gas passing upwards through the tube banks, to provide a cracked effluent; g) withdrawing the cracked effluent from the radiant zone to a quench header; h) introducing a pre-quenching oil containing crackable components to the quench header through a pre-quenching oil inlet for mixing with the cracked effluent, under conditions sufficient to substantially crack the crackable components in a cracking zone downstream of the pre-quenching oil inlet; i) introducing a quenching oil to the quench header through a quenching oil inlet downstream of the cracking zone to substantially terminate further cracking in the effluent of the cracking zone and provide a quenched effluent; and j) directing the quenched effluent to a recovery train.

In an embodiment of this aspect, the pre-quenching oil inlet communicates with a source of liquid bottoms phase derived from the vapor/liquid separator.

In still another embodiment of this aspect of the invention, the pre-quenching oil is selected from the group consisting of low sulfur vacuum pipestill bottoms, vapor/liquid separator bottoms from crude, vapor/liquid separator bottoms from hydrotreated crude, vapor/liquid separator bottoms from atmospheric resid, and vapor/liquid separator bottoms from hydrotreated atmospheric resid.

In still another aspect of the present invention, the process further comprises trapping coke and tar products in at least one tar filter downstream of the pre-quenching oil inlet.

DETAILED DESCRIPTION

Figure 1:
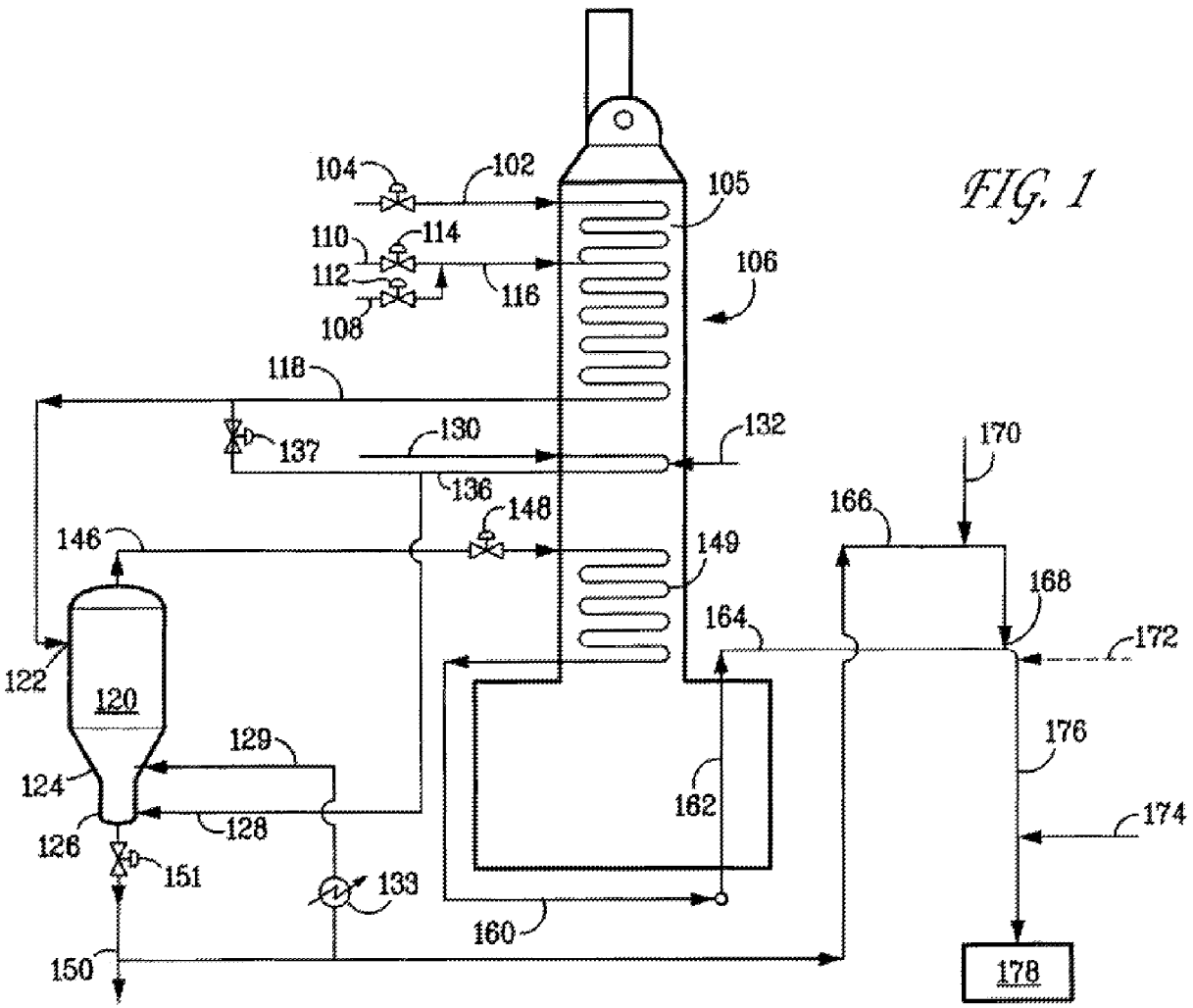
FIG. 1 illustrates a schematic flow diagram of the overall cracking apparatus and process in accordance with the present invention utilizing a quench header apparatus providing a pre-quenching zone upstream of the quenching zone, utilizing a pre-quenching oil containing crackable components.

Unless otherwise stated, all percentages, parts, ratios, etc. are by weight. Ordinarily, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

As used herein, resids are non-volatile components, e.g., the fraction of the hydrocarbonaceous feed with a nominal boiling point above 1100° F. (593° C.) as measured by ASTM D-6352-98 or D-2887. This invention works very well with non-volatiles having a nominal boiling point above 1400° F. (760° C.). The boiling point distribution of the hydrocarbonaceous feed is measured by Gas Chromatograph Distillation (GCD) by ASTM D-6352-98 or D-2887. Non-volatiles include coke precursors, which are large, condensable molecules that condense in the vapor, and then form coke under the operating conditions encountered in the present process of the invention. Asphaltenes, which may be present in resids, are n-heptane insoluble components. For present purposes, asphaltene content of a sample can be determined by well-known analytic techniques, e.g., ASTM D6560 (Standard Test for Determination of Asphaltenes (Heptane Insolubles) in Crude Petroleum and Petroleum Products), or ASTM D3270 (Standard Test Method for n-Heptane Insolubles).

Suitable hydrocarbonaceous feeds for use in the present invention include ethane, propane, butane, naphtha boiling range materials, as well as those boiling with a final boiling point in a temperature range from above about 356° F. (180° C.), such as feeds heavier than naphtha. Such feeds include those boiling in the range from about 200° F. to about 1200° F. (93° C. to 649° C.), say, from about 400° F. to about 1050° F. (204° C. to 566° C.). Typical heavier-than-naphtha feeds can include heavy condensates, gas oils, kerosene, hydrocrackates, crude oils, and/or crude oil fractions. Preferably, the hydrocarbonaceous feed is selected from low sulfur waxy residue, crude, atmospheric resid, hydrotreated atmospheric resid, hydrotreated vacuum resid, and hydrotreated crude.

The hydrocarbonaceous feeds can comprise a large portion, such as from about 5 to about 50%, of non-volatile components, i.e., resid. Suitable feeds for the present invention can comprise, by way of non-limiting examples, one or more of steam cracked gas oils and residues, gas oils, heating oil, jet fuel, diesel, kerosene, gasoline, catalytically cracked naphtha, hydrocrackate, reformate, raffinate reformate, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/residue admixture, naphtha/residue admixture, hydrocarbon gases/residue admixture, gas oil/residue admixture, and crude oil. These hydrocarbonaceous feeds can have a nominal end boiling point of at least about 600° F. (316° C.), generally greater than about 950° F. (510° C.), typically greater than about 1100° F. (590° C.), for example, greater than about 1400° F. (760° C.). The economically preferred feedstocks are generally low sulfur waxy residues, atmospheric residues, naphthas contaminated with crude, various residue admixtures and crude oil.

The hydrocarbonaceous feed may be initially heated by indirect contact with flue gas in a convection section tube bank of the pyrolysis furnace (or cracking furnace) before mixing with a dilution fluid, e.g., steam. Preferably, the temperature of the heavy hydrocarbonaceous feedstock is from about 300° F. to about 500° F. (149° C. to 260° C.) before mixing with the dilution fluid, preferably water and steam.

Following mixing with the primary dilution steam stream, the mixture stream may be heated by indirect contact with flue gas in a first convection section of the pyrolysis furnace before being flashed. Preferably, the first convection section is arranged to add the primary dilution steam stream, between subsections of that section such that the hydrocarbonaceous feeds can be heated before mixing with the fluid and the mixture stream can be further heated before being flashed.

The temperature of the flue gas entering the first convection section tube bank is generally less than about 1500° F. (816° C.), for example, less than about 1300° F. (704° C.), such as less than about 1150° F. (621°), and preferably less than about 1000° F. (538° C.).

Dilution steam may be added at any point in the process, for example, it may be added to the hydrocarbon feedstock before or after heating, to the mixture stream, and/or to the vapor phase. Any dilution steam stream may comprise sour steam. Dilution steam stream may be heated or superheated in a convection section tube bank located anywhere within the convection section of the furnace, preferably in the first or second tube bank.

The mixture stream may be at about 600° F. to about 1000° F. (316° C. to 538° C.) before introduction to the vapor/liquid separator or flash apparatus, e.g., knockout drum, and the flash pressure can be any suitable pressure, e.g., about 40 to about 200 psia (275 to 1375 kPa). Following the flash, 50 to 98% of the mixture stream can be in the vapor phase. The vapor phase can be heated above the flash temperature before entering the radiant section of the furnace, for example, to about 800° F. to about 1300° F. (427° C. to 704° C.). This heating may occur in a convection section tube bank, preferably the tube bank nearest the radiant section of the furnace, in the lower convection zone.

The temperature of the gaseous effluent at the outlet from the pyrolysis reactor is normally in the range of from about 1400° F. to about 1705° F. (760° C. to 929° C.). The hot gaseous effluent from the outlet of the radiant section of the steam cracker furnace is subjected to pre-quenching and quenching prior to further processing such as fractionation.

Pre-quenching with an oil containing crackable components such as $C_5^+$ paraffins, which will not produce substantial adverse effects on later steps in the process produces a reactive product stream of slightly reduced temperature, e.g., wherein cracking of the pre-quenching oil is still occurring. The pre-quenched stream is then subjected to quenching to reduce the temperature to an extent sufficient to stabilize the process gas stream and substantially terminate cracking. Pre-quenching oil is introduced at a temperature ranging from about 500° F. to about 1000° F. (260° C. to 538° C., say, from about 550° F. to about 1000° F. (288° C. to 538° C.) below the temperature of the process gas to which it is added.

In one embodiment of the present invention, the liquid bottoms from the vapor/liquid separator (or flash drum) can be directed to the quench header for use as a pre-quenching oil. Such bottoms, e.g., low sulfur vacuum tower bottoms (LSVTB), can be described as a 1000° F.$^+$ (538° C.$^+$) fraction of crude oil. These flash drum bottoms contain crackable components which crack in the presence of hot process gas leaving the fired radiant section. The pre-quenching oil can contain lower boiling crackable components as well, including $C_5^+$ crackable components, e.g., $C_5$ to $C_{20}$, or higher, preferably those boiling at or above 1000° F. (538° C.$^+$). Paraffins are especially suitable crackable components of the pre-quenching oil. Other crackable components include 1- and 2-ring naphthenes and 1-ring aromatics.

After pre-quenching, the process gas can be subjected to direct quench, at a point typically between the furnace outlet and the separation vessel (primary fractionator) or tar knockout drum. Such quench can be carried out in the quench header apparatus as described above, at a point downstream of the cracking zone. The quench is effected by contacting pre-quenched effluent with a liquid quench stream, in lieu of, or in addition to the treatment with transfer line exchangers. Suitable quench liquids include water and preferably, liquid quench oil, such as pyrolysis fuel oil and water, which can be obtained from various suitable sources, e.g., condensed dilution steam.

After passage through the direct quench, the cooled effluent is fed to a separation vessel, e.g., a primary fractionator.

The gaseous overhead of the separation vessel is typically directed to a recovery train for recovering $C_2$ to $C_4$ olefins, inter alia.

The invention is illustrated by the following Examples which are provided for the purpose of representation and is not to be construed as limiting the scope of the invention. Unless stated otherwise, all percentages, parts, etc., are by weight.

In an embodiment of the present invention depicted in FIG. 1, a hydrocarbonaceous feed stream 102, e.g., atmospheric resid or crude, is controlled by feed inlet valve 104 and the resulting feed is heated in an upper convection section 105 of a furnace 106. Then steam stream 108 and water stream 110, controlled by valves 112 and 114, respectively, are introduced through line 116 to the hydrocarbons in the upper convection section. The resulting mixture is further heated in the convection section where all of the water vaporizes and a large fraction of the hydrocarbon vaporizes. Typically, this heating is carried out to a temperature up to about 850° F. (454° C.), e.g., a temperature ranging from about 400° F. to about 900° F. (204° C. to 482° C.).

Exiting upper convection section 105, the mixture stream 118, generally at a temperature of about 850° F. (454° C.) enters a vapor/liquid separation apparatus or flash drum 120 by a tangential inlet 122 where a vapor/liquid separation occurs. The vapor is at its dew point. The liquid resid falls to the bottom section 124 of the flash drum and into a cylindrical boot 126, where cooled recycle bottoms introduced via line 129 can be added to prevent excessive coking of the liquid bottoms. The liquid bottoms are withdrawn through line 150 controlled by valve 151. A portion of the bottoms 150 is diverted through heat exchanger 133, producing cooled bottoms 129 which quenches the bottoms at 126.

Additional dilution steam stream 130 is superheated in the convection section 106, desuperheated by water 132 and the discharged steam is passed via line 136 and introduced via valve 137 to line 118 to vaporize additional hydrocarbon before the mixture in 118 enters flash drum 120 via tangential inlet 122.

The overhead from the flash drum 120 is directed via line 146 to control valves 148 to lower convection section 149. Steam diverted from line 136 via line 128 reduces the viscosity of the partially visbroken liquid in the boot 126 while stripping additional light hydrocarbons from the bottoms.

The steam/hydrocarbon vapor derived from the flash drum overhead passes from the lower convection section 149 via crossover piping 160 and through the radiant section 162 of the furnace where it undergoes cracking. The cracked effluent exits the radiant section through a quench header apparatus comprising a horizontal transfer line 164 and is pre-quenched with crackable pre-quenching oil taken from line 166 which supplies liquid bottoms taken from the flash drum 120 via line 150 to a pre-quenching oil nozzle 168 at the elbow/tee of the quench header apparatus. A supplemental or substitute source of crackable pre-quenching oil can be fed via line 170. An optional upper quench inlet (secondary quenching oil inlet) 172 is available to provide quench oil in the event of operation without pre-quenching oil. Lower quench oil inlet (primary quenching oil inlet) 174 introduces quenching oil to the pre-quenched process gas stream whose crackable components from pre-quenching oil are at least partially cracked in pre-quenching cracking zone 176 located between the pre-quenching oil inlet nozzle 168 and the lower quenching oil inlet 174. The quenching oil reduces process gas temperature below cracking temperature resulting in a cracked, stabilized process gas subsequently treated by recovery train 178 to provide a lower olefins product stream.

Figure 2:
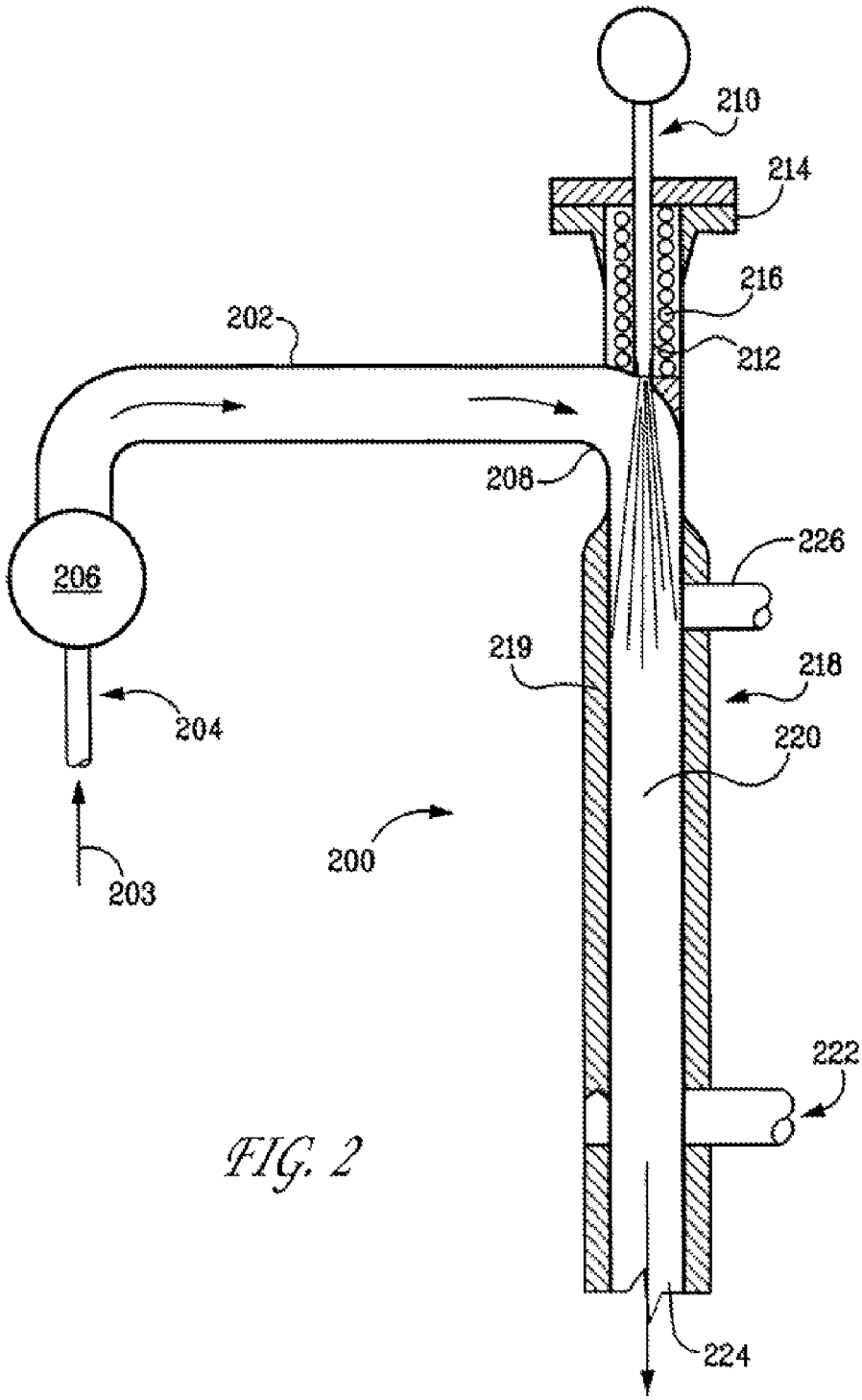
FIG. 2 illustrates the quench header apparatus and its use in accordance with the present invention.

FIG. 2 is a detailed depiction of an embodiment of a quench header apparatus 200 of the present invention. The apparatus comprises a horizontal transfer pipe 202 for receiving hot cracked process gas effluent 203 passing from radiant furnace cracking tube(s) 204 to a radiant coil outlet manifold 206. Hot cracked process gas passes through a tee fitting mounted at elbow 208 at which location is mounted a pre-quenching injection line 210 terminating in a downwardly pointing injection nozzle 212. The injection line is mounted through a tee fitting 214 at the elbow and is supplied by a suitable source of pre-quenching oil, e.g., liquid bottoms taken from a flash drum. The tee fitting can include a suitable heat insulating material 216 such as ceramic fiber insulation. The elbow 208 on which is mounted the tee fitting 214 terminates in a vertical annular quench header (or downcomer) 218 which can include an insulating jacket 219. Hot cracked process gas is mixed with pre-quenching oil within the elbow itself and immediately downstream of the elbow in a cracking zone 220 which is maintained under conditions sufficient to enable substantial cracking of crackable components present in the pre-quenching oil. Suitable pre-quenching oil temperatures at the injection nozzle 212 can range from about 400° F. to about 900° F. (204° C. to 482° C.), say, from about 750° F. to about 860° F. (399° C. to 460° C.), and are sufficient to adequately cool the process gas by, say, from about 50° F. to about 100° F. (28° C. to 56° C.) prior to quenching, while permitting substantial cracking of the crackable components in the pre-quenching oil. Pre-quenching oil is added in amounts sufficient to provide from about 1 to about 20 wt %, say, from about 5 to about 10 wt % pre-quenching oil in the mixture resulting from injection of pre-quenching oil to the process gas. Quench oil is injected through a lower quench injection nozzle 222 downstream of the cracking zone 220. The resulting stabilized process gas, in which cracking has substantially ceased, is taken via outlet 224 for further processing. Optionally, upper quench oil inlet 226 can be used to effect further quenching during operations where pre-quenching is not being practiced or when the pre-quench zone requires periodic flushing or spalling of coke.

The present invention is especially suited to economically advantageous use of bottoms from a vapor/liquid separation apparatus (flash drum) used to treat resid-containing feeds such as low sulfur waxy residue (LSWR) upstream of the radiant zone of a steam cracker, to produce an overhead that avoids dry point coking of the convection section downstream. The resulting bottoms, while containing resids such as asphaltenes and non-crackable sulfur, contain crackable molecules that can economically provide additional lower olefins and steam crack naphtha yields when subjected to cracking conditions. In present practice, the presence of asphaltenes in the bottoms discourages its use as feed to the steam cracker and necessitates use of the bottoms in lower value applications, such as fuel oils. The presence of paraffins in the bottoms renders it unfit as a quench oil because uncracked paraffins tend to precipitate tar asphaltenes in the transfer line and primary fractionator downstream of the quench point.

Although asphaltenes concentrate in the bottoms, its feed hydrogen content is almost as much as the total feed. The TABLE below summarizes the PINA and feed hydrogen in 650° F. to 1000° F. (343° C. to 538° C.) Tapis gas oil and the flash drum bottoms 1000° F.$^+$ (538° C.$^+$).

TABLE

| Tapis LSWR Wt % | 650° F.-1000° F. (343° C.-538° C.) | 1000° F.$^+$ (538° C.$^+$) Bottoms | 90/10 Composite | 95/5 Composite |
|---|---|---|---|---|
| Paraffins | 38.20 wt % | 6.88 wt % | 35.07 wt % | 36.63 wt % |
| Isoparaffins | 13.90 wt % | 5.03 wt % | 13.01 wt % | 13.46 wt % |
| Naphthenes | 24.80 wt % | 23.48 wt % | 24.67 wt % | 24.73 wt % |
| Aromatics | 23.10 wt % | 64.61 wt % | 27.25 wt % | 25.13 wt % |
| H | 13.59 wt % | 12.93 wt % | 13.52 wt % | 13.56 wt % |

From a pyrolysis yield point of view, the bottoms (LSVTB) are very aromatic so the best that can be done is naphthene ring opening to produce smaller aromatics like steam crack naphtha (SCN), e.g., benzene, while cracking the aromatic and naphthenic side chains to light olefins. Turning fuel oil into SCN and $C_4^-$ with some tar is, overall, a very desirable upgrade of LSVTB. In the LSVTB, the asphaltene content in the 1000° F.$^+$ (538° C.$^+$) cut is about 2.7 wt %.

Simulations on Tapis LSWR for adding 10% and 5% LSVTB into the pre-quench zone and partially cracking it prior to the normal quench oil injection were carried out. The vapor/liquid separator bottoms (LSVTB) are introduced in the original elbow/tee location directly upstream of the vertical annular quench header. The cracking zone between the pre-quench injection point and quench point is of sufficient length to provide optimal residence time for cracking the pre-quench oil's crackable components. Residence time is about 0.06 seconds and cracking occurs in about 12 feet (3.6 meters) of the unfired cracking zone at 200 feet per second (61 meters per second) process gas velocity. Coking is managed by providing a large pre-quenching oil inlet having a nozzle about 1 inch (2.5 cm) in diameter. The pre-quench zone is typically about 10 inches in diameter (25 cm). Given the relatively low paraffin levels in LSVTB, tar precipitation is not expected downstream of the pre-quenching oil inlet.

The runs hold the base feed rate constant and add LSVTB in amounts such that it represents 10 wt % or 5 wt % of the resulting mixture. It appears that the 10% injection of LSVTB makes methane and suppresses propylene because of a slight quenching effect of the LSVTB at higher levels which lowers the unfired temperature profile and slightly reduces the base feed severity.

The results predict the LSVTB will crack mainly to SCN (largely benzene), methane and ethylene, steam crack gas oil (SCGO) and tar. The LSVTB will crack well in the unfired outlet zone (cracking zone of the quench header apparatus) as the temperature cools down from 1484° F. to 1407° F. (807° C. to 764° C.) at 10% LSVTB and 1446° F. (786° C.) at 5% LSVTB pre-quench. At 5% LSVTB, SCN including benzene, and tar levels are about the same. The tar would include unconverted feed but the calculations do not indicate the amount of unconverted feed. As LSVTB pre-quench rate goes up to 10%, the SCN with benzene yield decreases about 11% while, tar increases by about 12%, directionally indicating lower conversion as more LSVTB is added. SCGO yield is about the same in both cases.

It is assumed for both 5% and 10% LSVTB cases that coke yield does not significantly impact the product upgrade from turning LSVTB to a large portion of motor gasoline and $C_4^-$, it does not impact operability of the furnace but affects the coking in the pre-quench/quench header and affects the attendant coke handling requirements. Use of automation and disposal of coke to fuel for maximum upgrade and elimination of disposal waste are desirable to improve the efficiency of the present invention.

The 5% LSVTB pre-quench amount is especially effective, but it can be further optimized by ensuring sufficient cracking to avoid problems with coke in the pre-quench zone area and management of the coke in the tar in primary fractionator filters downstream. Tar incompatibility is not expected because total unconverted paraffins will be very low with only 5-10 wt % LSVTB. Because pentane insolubles (PI) will go through a dry point, it is expected that the cracking zone of the quench header should be periodically flushed with quench oil. The quench oil can be automatically added periodically to flush out coke from the LSVTB, mainly due to the PI. The quench oil flush can be carried out about every 6 to 24 hours for about 15 to 30 minutes with flush quenching oil injected through both the pre-quenching oil inlet nozzle and the upper quench point if present. Quench water may also be used to spall off the coke. The portion of flushed coke that is insoluble in the quench oil flush can be removed downstream in tar filter(s), say, in those filters associated with the primary fractionator.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A process for quenching hot cracked hydrocarbonaceous effluent that comprises:

a) introducing hot cracked hydrocarbonaceous effluent to a quench header;

b) introducing a pre-quenching oil containing crackable C5+ components to the quench header through a pre-quenching oil inlet for mixing with the hot cracked hydrocarbonaceous effluent, under conditions sufficient to substantially crack the crackable components in a cracking zone downstream of the pre-quenching oil inlet wherein the pre-quenching oil is a 538° C.$^+$ fraction containing from about 10 to about 80 wt % aromatics, from about 2 to about 3 wt % asphaltenes, from about 0.1 to about 5 wt % sulfur, and from about 0 to about 30 wt % paraffins and wherein the pre-quenching oil inlet and the primary quenching oil inlet are separated to an extent sufficient to provide a process gas residence time ranging from about 0.04 to about 0.09 seconds for the cracked effluent and pre-quenching oil at a process gas flow rate between about 100 and about 300 feet/second; and c) introducing a quenching oil to the quench header through a primary quenching oil inlet downstream of the cracking zone to substantially terminate further cracking in the effluent of the cracking zone and provide a quenched effluent.

2. The process of claim 1 which further comprises: supplying a liquid bottoms phase derived from a vapor/liquid separator to the pre-quenching oil inlet.

3. The process of claim 1 wherein the pre-quenching oil is selected from the group consisting of vacuum pipestill bottoms, vapor/liquid separator bottoms from crude, vapor/liquid separator bottoms from hydrotreated crude, vapor/liquid separator bottoms from atmospheric resid, and vapor/liquid separator bottoms from hydrotreated atmospheric resid.

4. The process of claim 1 wherein the pre-quenching oil is introduced to the hot cracked hydrocarbonaceous effluent at a rate sufficient to provide a mixture containing from about 1 to about 20 wt % pre-quenching oil in the cracking zone.

5. The process of claim 1 which further comprises introducing quench oil and/or water through a secondary quenching oil inlet between the pre-quenching oil inlet and the primary quenching oil inlet for periodic flushing and/or spalling of coke and/or coke precursors.

6. A process for cracking hydrocarbonaceous feed that comprises:

a) preheating the feed in one or more tube banks of a convection zone of a furnace, the feed being introduced to the tube bank(s) through at least one hydrocarbonaceous feed inlet;

b) mixing the hydrocarbonaceous feed with water and steam added to the tube bank(s) via one or more inlets for introducing water and steam and removing the resulting heated mixture stream through an outlet in the tube bank(s);

c) directing the heated mixture stream to a vapor/liquid separator;

d) flashing the heated mixture stream in the vapor/liquid separator to provide a liquid bottoms phase and an overhead vapor phase;

e) directing the overhead vapor phase to a tube bank of the convection zone in order to further heat the overhead vapor phase;

f) cracking the further heated overhead vapor phase in a radiant zone beneath the convection zone, which includes burners producing flue gas passing upwards through the tube banks, to provide a cracked effluent;

g) withdrawing the cracked effluent from the radiant zone to a quench header;

h) introducing a pre-quenching oil containing crackable components to the quench header through a pre-quenching oil inlet for mixing with the cracked effluent, under conditions sufficient to substantially crack the crackable components in a cracking zone downstream of the pre-quenching oil inlet; wherein the pre-quenching oil wherein the pre-quenching oil is a 538° C.$^+$ fraction containing from about 10 to about 80 wt % aromatics, from about 2 to about 3 wt % asphaltenes, from about 0.1 to about 5 wt % sulfur, and from about 0 to about 30 wt % paraffins and wherein the pre-quenching oil inlet and the primary quenching oil inlet are separated to an extent sufficient to provide a process gas residence time ranging from about 0.04 to about 0.09 seconds for the cracked effluent and pre-quenching oil at a process gas flow rate between about 100 and about 300 feet/second; and i) introducing a quenching oil to the quench header through a quenching oil inlet downstream of the cracking zone to substantially terminate further cracking in the effluent of the cracking zone and provide a quenched effluent; and j) directing the quenched effluent to a recovery train.

7. The process of claim 6 wherein the pre-quenching oil is selected from the group consisting of vacuum pipestill bottoms, vapor/liquid separator bottoms from crude, vapor/liquid separator bottoms from hydrotreated crude, vapor/liquid separator bottoms from atmospheric resid, and vapor/liquid separator bottoms from hydrotreated atmospheric resid.

8. The process of claim 6 wherein the pre-quenching oil comprises vacuum pipestill bottoms.

9. The process of claim 6 wherein the pre-quenching oil is introduced to the cracked effluent at a rate sufficient to provide a mixture containing from about 3 to about 10 wt % pre-quenching oil in the cracking zone.

10. The process of claim 6 which further comprises trapping coke and tar products in at least one tar filter downstream of the pre-quenching oil inlet.

* * * * *